United States Patent [19]

Crouch et al.

[11] Patent Number: 4,915,218

[45] Date of Patent: Apr. 10, 1990

[54] BASKET CARRIER WITH TWO PIECE BLANK

[75] Inventors: Elmoe Crouch, Franklin, Ohio; Norbert Hoell, Southgate, Ky.; Jeffrey A. Lashyro, Crosby, Minn.

[73] Assignee: Minnesota Automation Inc., Crosby, Minn.

[21] Appl. No.: 354,338

[22] Filed: May 23, 1989

[51] Int. Cl.[4] ..... B65D 85/72

[52] U.S. Cl. ..... 206/178; 229/120.38

[58] Field of Search ..... 206/155, 162, 170–189, 206/427, 428, 434; 229/52 BC, 120.18, 120.33, 120.38, 120.15

[56] References Cited

U.S. PATENT DOCUMENTS

| | | | |
|---|---|---|---|
| Re. 29,063 | 12/1976 | Graser | 206/178 |
| 2,974,827 | 3/1961 | Levkoff | 206/186 |
| 3,070,258 | 12/1962 | Engel | 206/177 |
| 3,232,477 | 2/1966 | Woodling | 206/188 |
| 3,278,076 | 10/1966 | Graser | 206/173 |
| 3,581,933 | 10/1971 | Engdahl, Jr. | 206/178 |
| 4,469,222 | 9/1984 | Graser | 206/180 |
| 4,741,436 | 5/1988 | Davis | 206/178 |
| 4,782,944 | 11/1988 | Engdahl, Jr. | 206/170 |

*Primary Examiner*—Stephen Marcus

*Attorney, Agent, or Firm*—Wood, Herron & Evans

[57] ABSTRACT

A basket carrier fabricated from two separate blanks, one of the blanks forming the carrier's body which includes opposed side walls, opposed end walls, and a floor, and the other of the blanks forming the carrier's center wall and cell divider panels. In preferred form, the center wall blank includes end wall connector flaps by which the center wall is fixed to the carrier's end walls, and floor connector tabs by which the center wall is fixed to the body's floor.

4 Claims, 5 Drawing Sheets

BASKET CARRIER WITH TWO PIECE BLANK

This invention relates to bottle carriers. More particularly, this invention relates to basket style bottle carriers.

There are innumerable different bottle and can carrier structures known to the prior art. These carriers are commonly used by the beverage industry in marketing of, e.g., beer and soft drink products. Of the various types of carriers used in the beverage industry, one of the most common types is known in the trade as a basket style carrier. The basket carrier includes opposed side walls, opposed end walls and a floor with partitions interiorly of the walls defining multiple cells. This style carrier commonly includes six or eight cells, the cells being provided in two side by side rows of three or four cells each which are divided by a center wall. In use, a filled beverage bottle is positioned within each open top cell, and is supported within that cell by the carrier's floor. A handle is provided in the center wall to permit easy lifting and carrying of a fully loaded carrier by a retail consumer.

It is conventional in the basket carrier business to fabricate the basket carrier from a one piece blank. In other words, the manufacturer cuts and scores a single sheet of paperboard to form a one piece blank, and then folds and glues that one piece paperboard blank to produce the commercial basket carrier. A typical top loading basket carrier of this type is illustrated in U.S. Pat. No. 4,319,682.

There are several practical problems in the manufacture of basket carriers with one piece blanks as known to the prior art, and the basket carrier with two piece blank in accord with the principles of this invention constitutes an improvement relative to those problems. One problem with one piece blank basket carriers is that the end walls of those carriers often have glued seams, i.e., one or both end walls is each comprised of two separate end wall panels which are glued one to the other. The exterior face of each side wall and each end wall on basket carriers is printed with the beverage supplier's graphics. If the two end panels that form an end wall of the basket carrier are not perfectly aligned, when those end wall panels are glued together the graphics on that end wall will be misaligned or broken. With the two piece basket carrier of this invention there are no glued seams interiorly of the top, bottom, and side edges of either end wall, and this allows for uninterrupted graphics over those end walls so no printing misalignment or broken graphics problems can exist on the carrier's end walls. Second, a one piece blank results in a basket carrier where the carrier's center wall must be fabricated of the same kind of material and the same weight of material, e.g., a single weight paperboard, as the carrier's body. With the two piece blank basket carrier of this invention, the carrier's center wall and body components can be manufactured of two different materials, e.g., plastic and paperboard, or those two components can be manufactured of the same material but of different weight or grade, e.g., different weights or grades of paperboard, in order to enhance the physical properties, or reduce the cost, or both, of the basket carrier product. And third, the production cost of basket carriers is always an issue for the manufacturer because the basket carrier business is a highly competitive business. Anything that a producer can do to cut costs, therefor, is desirable. The two piece basket carrier blank of this invention, relative to the one piece blank basket carrier, can be manufactured with lesser printing costs for the body graphics because with the carrier of this invention the body blank is separate from the center wall blank. This means that only the body blank must be passed through the printing process. The two piece blank of this invention also allows the manufacturer to use a standard center wall blank with multiple body blanks (which are different one from the other only because of different graphics), thereby reducing the manufacturer's inventory for the center wall component of the basket carrier. Further, the two piece basket carrier blank of this invention, relative to the one piece basket carrier blank, allows higher production line speeds because it is easier to glue the carrier's center wall blank and body blank components one to the other which results in faster gluing speeds. And also, the two piece blank basket carrier of this invention can be fabricated from less total paperboard than a one piece blank in certain situations which, of course, also results in a more economical manufacturing cost.

Accordingly, it has been an objective of this invention to provide a basket carrier fabricated from two separate blanks, one of the blanks forming the carrier's body which includes opposed side walls, opposed end walls, and a floor, and the other of the blanks forming the carrier's center wall and cell divider panels. In preferred form, the center wall blank includes end wall connector flaps by which the center wall is fixed to the carrier's end walls, and floor connector tabs by which the center wall is fixed to the body's floor.

Other objectives and advantages of this invention will be more apparent from the following detailed description taken in conjunction with the drawings in which.

Figure 1:
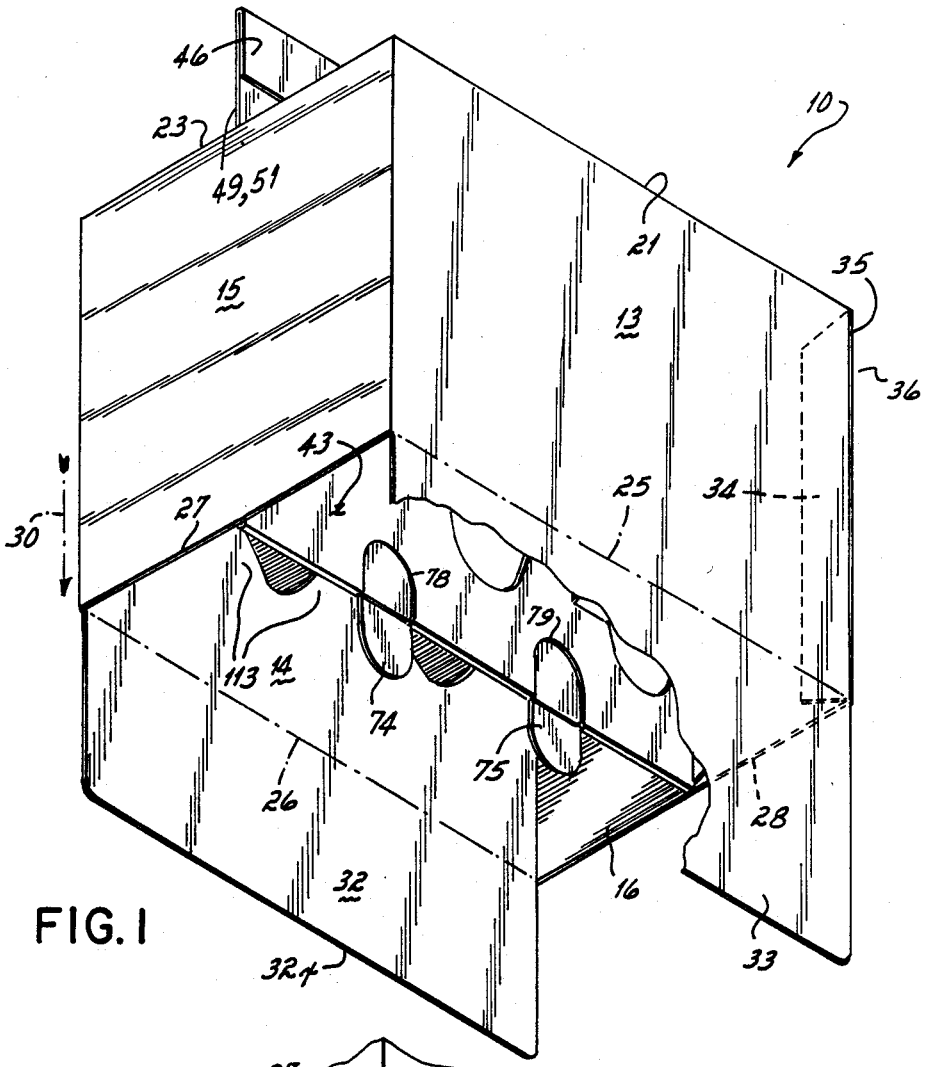
FIG. 1 is a perspective view illustrating a bottom loading basket carrier assembled in accord with the principles of this invention, and in erected or set up configuration prior to being loaded with bottles.
Figure 11:
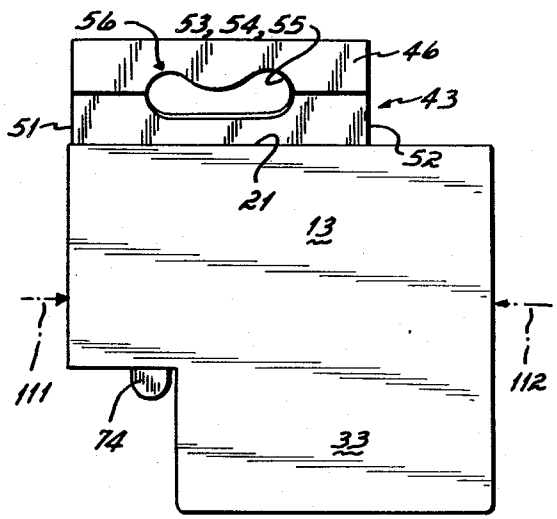
Figure 10:
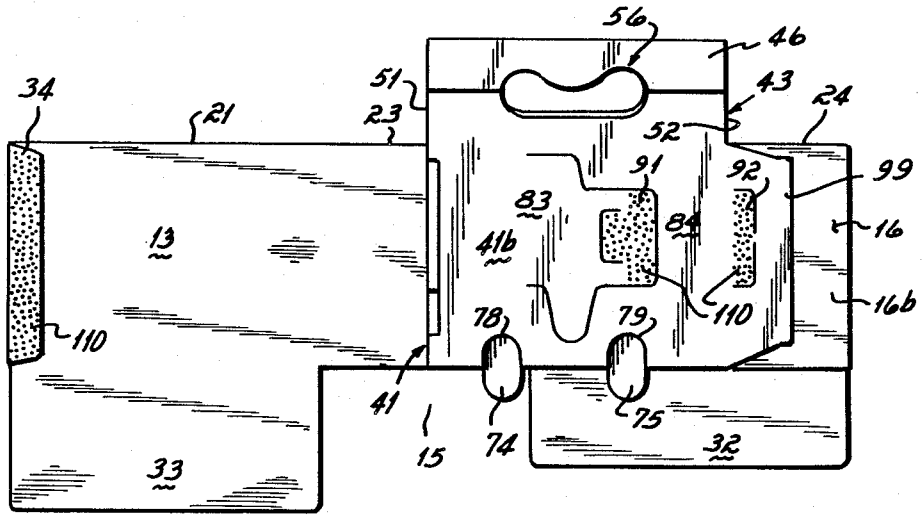
FIG. 10 is a view similar to FIGS. 8 and 9 illustrating a third step in assembly of the preassembled center wall blank with the body blank.
Figure 12:
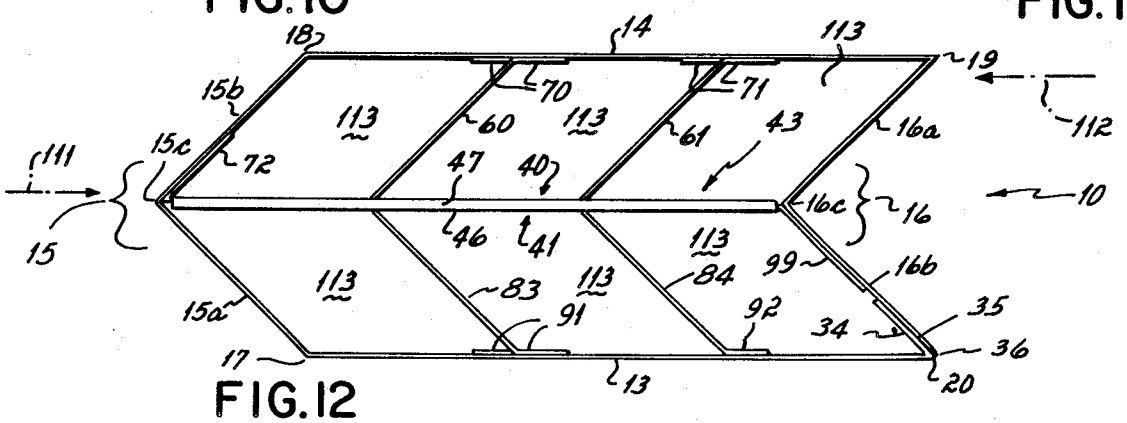

FIG. 11 is a view similar to FIG. 10 illustrating the final assembly step of the body blank with the preassembled center wall blank, the basket carrier illustrated in FIG. 11 being shown in the knock-down configuration ready to be erected for use as shown in FIG. 1, and FIG. 12 is a partially erected top plan view of the carrier as it is being transformed from the knock-down configuration of FIG. 11 to the use configuration of FIG. 1.

Figure 2:
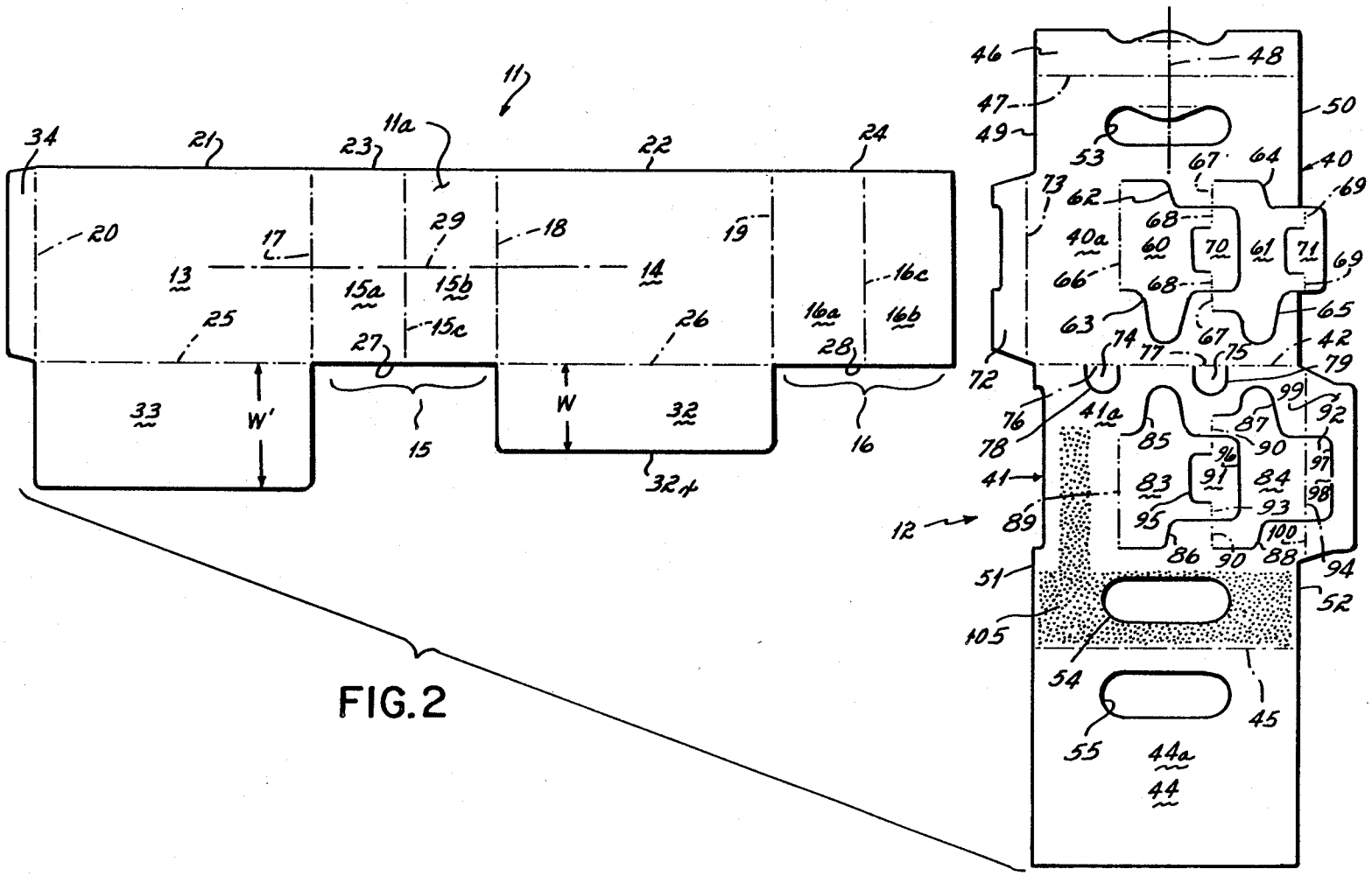
FIG. 2 is a top view of two separate blanks which, when joined, result in the carrier of FIGS. 1 and 1A, the body blank and the center wall blank being shown in the as-cut form, and the center wall blank being shown prepared for the first assembly step.

A bottom loading basket carrier 10 in accord with the principles of this invention is illustrated in FIG. 1 in erected or set-up configuration, prior to being loaded with bottles. The separate body blank 11 and center wall blank 12 from which the carrier 10 is fabricated are shown in FIG. 2. Gluing of the blanks 11, 12 into the assembled but knock-down carrier 10 configuration shown in FIG. 11 is illustrated in sequence in FIGS. 3–10.

One of the two separate blanks, as noted, is a body blank 11, and the other of the two separate blanks is a center wall blank 12. Note particularly that, because the body blank 11 and the center wall blank 12 are separate one from the other the body blank can be manufactured from one kind of material, e.g., plastic or paperboard, and the center wall blank can be manufactured from another kind of material. Alternatively, the body blank 11 can be manufactured from one grade or weight of one kind of material, e.g., paperboard, and the center wall blank 12 can be manufactured from another grade or weight of that same material. This adjustability allows the physical properties, e.g., load carrying capability, of the basket carrier 10 to be varied, and/or allows the manufacturing costs of the carrier to be varied, depending on customers' needs.

The body blank 11, as illustrated in FIG. 2, is comprised of two side walls 13, 14 and two end walls 15, 16. Each of the end walls is comprised of two end wall panels 15*a*, 15*b* and 16*a*, 16*b*, those panels being separated one from the other by a score line 15*c*, 16*c* parallel to those score lines 17, 18,19 and 20 which define end edges of the respective adjacent side walls 13, 14. The side walls 13, 14 and end walls 15, 16 are each also defined by common top edges 21–24 which are co-axial one with the other, and by common bottom edges 25–28 which are co-axial one with the other. The body blank's layout, from left to right as shown in FIG. 2, comprises side wall 13, end wall 15, side wall 14, and end wall 16, same all being oriented along a longitudinal axis 29 which is normal to those walls' end edges 17–20.

Figure 1A:
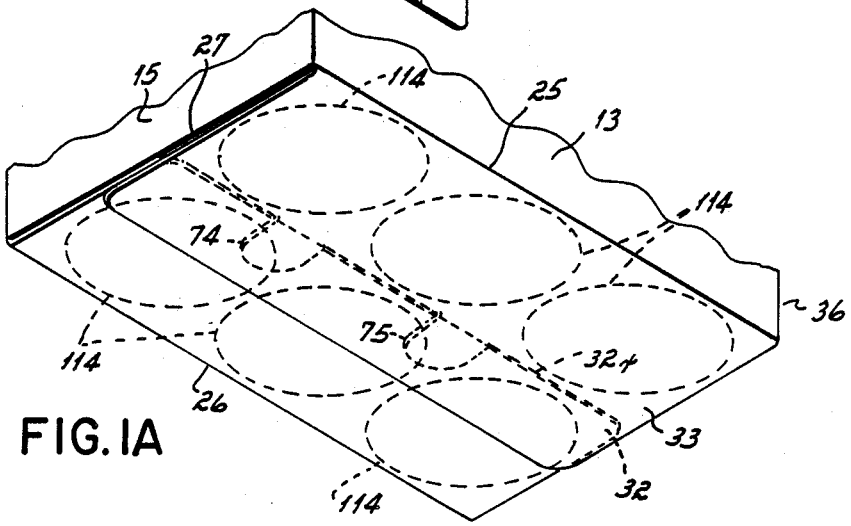
FIG. 1A is a view of the carrier's floor from the same perspective shown in FIG. 1, but with the floor in final glued position after the carrier has been loaded with bottles.

The body blank 11 also includes first 32 and second 33 floor panels, the first floor panel 32 being connected to side wall 14 on fold line 26, and the second floor panel 33 being connected to side wall 13 on fold line 25, those fold lines 25 and 26 being co-axial with and, in effect partially defining, the bottom edge 25–28 of the body blank 11. Note the width W of the floor panel 32 is substantially equal to one-half the width of the basket carrier as shown in FIG. 1, and the width W' of the floor panel 33 is significantly greater than one-half the width of the basket carrier, so that those floor panels 32, 33 can overlap one another in final assembly as shown in FIG. 1A. It is important to note these floor panels 32, 33 are not glued together by the carton manufacturer when the carrier is in the flattened or knock-down shipping attitude shown in FIG. 11. Hence, when the assembled carrier is erected (see FIG. 1) by a bottler prior to loading, the floor panels 32, 33 are opened like doors so the carrier can be lowered (as shown by phantom arrow 30) over a matrix (not shown) of beverage-filled bottles.

The body blank 11 also includes a glue flap 34 fixed to end edge of side wall 13, same being connected to that side wall on fold line 20. This glue flap 34 cooperates with end wall panel 16*b* of en wall 16 in the assembled basket carrier 10 to retain the body blank 11 in the body configuration shown in FIG. 1, the seam 35 so formed being located at corner 36 of the basket carrier. Note particularly that no other seams or joints are formed in the carrier's end walls 15, 16 or side walls 13, 14 when the body blank 11 is glued to the center wall blank 12 to form the basket carrier 10, i.e., each end wall 15, 16 even though it is comprised of two separate end wall panels 15*a*, 15*b* and 16*a*, 16*b* foldably connected on fold lines 15*c*, 16*c* relative one to the other, will have no glued seam or joint. This allows for uninterrupted graphics to be printed over the entirety of both basket end walls 15, 16 so that no printing misalignment or broken graphic problems can exist. Further, and because the body blank 11 is separate from the center wall blank 12, the center wall blank can be a standardized or single inventory item that can be used with, for example, a number of different body blanks each of which are of the same structure but each of which are printed with different graphics. In other words, the same basket carrier 10 structure can be used by multiple beverage manufacturers, but the carrier manufacturer can more easily control inventory because the body blanks 11 are printed separately and the center wall blanks 12 do not have to be printed at all.

Figure 6:
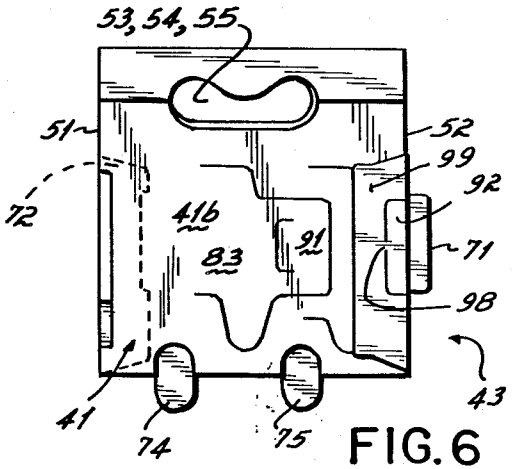
FIG. 6 is a view similar to FIG. 5 showing the center wall blank in a fourth assembly step where it is fully pre-assembled and folded for assembly with the body blank.
Figure 7:
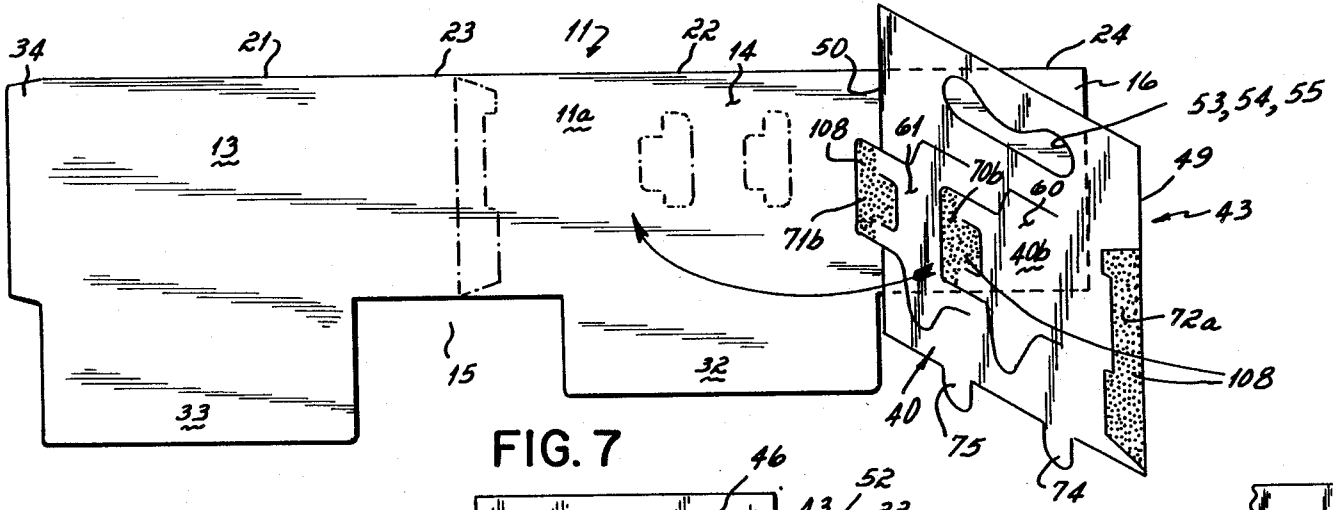
FIG. 7 is a combination plan and perspective view showing the pre-assembled center wall blank in the process of the first assembly step with the body blank.

The center wall blank 12 includes a first cell divider panel section 40, and a second cell divider panel section 41, same being connected one to the other by fold line 42 which constitutes the bottom edge of the carrier's center wall 43 (FIGS. 1 and 7). A center reinforcement panel 44 is connected to the second cell divider section panel 41 on fold line 45 which constitutes a top edge of the carrier's center wall 43. A glue flap 46 is connected to the first cell divider panel section 40 on fold line 47 which also constitutes the top edge of the carrier's center wall 43. Note that the first cell divider panel section 40, the second cell divider panel section 41, and the center reinforcement panel 44, are all oriented on a longitudinal axis 48 oriented parallel to the end edges 49, 50 and 51, 52 of the cell divider panels sections 40, 41, respectively. Each of the cell divider panels' sections 40, 41 and the center reinforcement panel 44 is provided with hand cutouts 53, 54, 55 respectively, adapted to overlie one another (see FIG. 11) for access by the carrier's user when the carrier 10 is erected and in use. These hand cutouts 53–55 are located adjacent the top edge 45, 47 of the center wall 43 when the center wall blank 12 is folded into final pre-assembly configuration, see FIG. 6. In that final preassembly configuration, the center reinforcement panel 44 is oriented between the two cell divider panel sections 40, 41, and the glue flap 46 overlies the top edge 45 of the center reinforcement panel 44 and is glued to the top portion of the second cell divider panel section 41 so as to provide the final handle 56 configuration for the basket carrier 10 (FIGS. 7 and 11).

The first cell divider panel section 40 includes two cell divider panels 60, 61 which are formed from that section by cut lines 62, 63 and 64, 65, respectively.

These cell divider panels 60, 61 remain foldably connected to the cell divider pane section 40 on fold lines 66, 67, respectively, those fold lines being oriented parallel to the blank's longitudinal axis 48 and parallel to the end edges 49, 50 of that cell divider panel section. Each cell divider panel 60, 61 is foldably connected at its outer edge on fold line 68, 69, respectively, with a glue tab 70, 71, respectively. It is by virtue of the glue tabs 70, 71 that the cell divider panels 60, 61 are connected to side wall 14 as explained in greater detail below. The first cell divider panel section 40 also includes an end wall connector flap 72 foldably connected thereto on fold line 73. This end wall connector flap 72 allows the center wall 44 to be connected to end wall 15 during assembly of the carrier 10 as explained in further detail below. Note also, that the cell divider panel section 40 has floor connector tabs 74, 75 connected thereto on fold lines 76, 77, respectively. These floor connector tabs 74, 75 are defined by cut lines 78, 79, respectively, in the second cell divider panel section 41 along the joint bottom edge 42 of the first 40 and second 41 cell divider panel sections. These floor connector tabs 74, 75 are located, therefor, between end edges 49–52 of the yet-to-be-formed center wall 43.

The second cell divider panel section 41 includes cell divider panels 83, 84. The cell divider panels 83, 84 are defined by cut lines 85, 86 and 87, 88, respectively, located interiorly of the end edges 49–52 of the center wall blank 12. Each of the cell divider panels 83, 84 is connected with the cell divider panel section 41 on fold lines 89, 90, respectively. Each cell divider panel 83, 84 also includes a glue tab 91, 92, respectively, connected thereto on fold lines 93, 94 respectively. One glue tab 91 is partially cut out of the cell divider panel 83 as shown by cut line 95 and partially cut out of the adjacent cell divider panel 84 as shown by cut line 96. The other glue tab 92, however, is defined by cut line 97 which incorporates a breakout point 98. In other words, the cut line 97 which defines the glue tab 92 for cell divider panel 84 is cut from end wall connector flap 99 of the blank 12 so as to ensure that that glue tab 92 will remain contiguous with that end wall connector flap 99 during the assembly process of the center wall blank 12 until it is desired that same be broken apart therefrom as explained in detail below. The end wall connector flap 99, which connects the center wall 43 with the other end wall 16 of the body blank 11 during assembly, is connected to end edge 52 of the second cell divider panel section 41 on fold line 100.

Assembly or fabrication of the basket carrier 10 from the body blank 11 and the center wall blank 12, i.e., the as-cut blank 11, 12 configuration, as shown in FIG. 2, into the glued knock-down configuration shown in FIG. 11, involves a series of separate gluing and folding steps as shown in sequence in FIGS. 3–10.

The initial step is to pre-assemble the center wall blank 12 as illustrated in FIGS. 3–6. First, the obverse face **41*a* of the second cell divider panel section 41 is provided with glue as shown by the stippling area 105 in FIG. 2, and the center reinforcement panel 44 then folded on fold line 45 onto the second cell divider panel section. This glues the obverse face 44*a* of the center reinforcement panel 44 to the obverse face 41*a* of the second cell divider panel section 41 in that area 105 where glue was applied as shown in FIG. 2. Subsequently, glue is applied to the obverse face 40*a* of the first cell divider panel section as shown by stippling areas 106 in FIG. 3. The reverse face 44*b* of the center reinforcement panel 44 is then folded on fold line 42 so that the reverse face of the center reinforcement panel and certain portions of the obverse face 41*a* of the second cell divider panel section 41 are glued to the obverse face 40*a* of the first cell divider panel section 40 in those stippled areas 106 shown in FIG. 3, thereby establishing the FIG. 4 intermediate pre-assembly position for the center wall blank 12. In this FIG. 4 position, and as the second cell divider panel section 41 and the center reinforcement panel 44 are folded on fold line 42, note the floor connector tabs 74, 75 formed out of the second cell divider panel section 41 remain co-planar with, i.e., are not folded relative to, the first cell divider panel section 40**.

Figure 5:
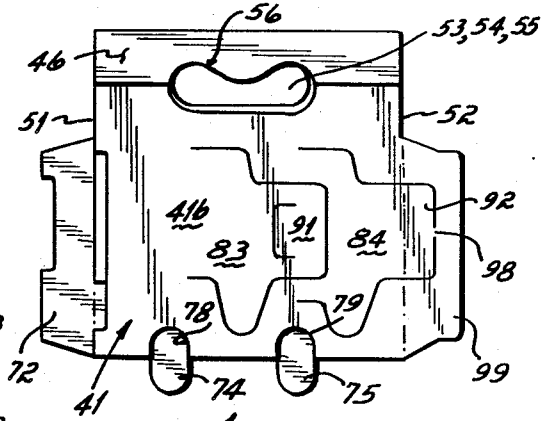
FIG. 5 is a view similar to FIG. 4 showing the center wall blank in a third assembly step.
Figure 4:
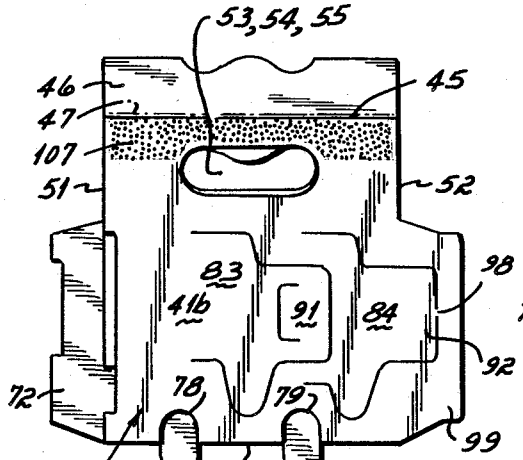
FIG. 4 is a view similar to FIG. 3 showing the center wall blank in a second assembly step.
Figure 3:
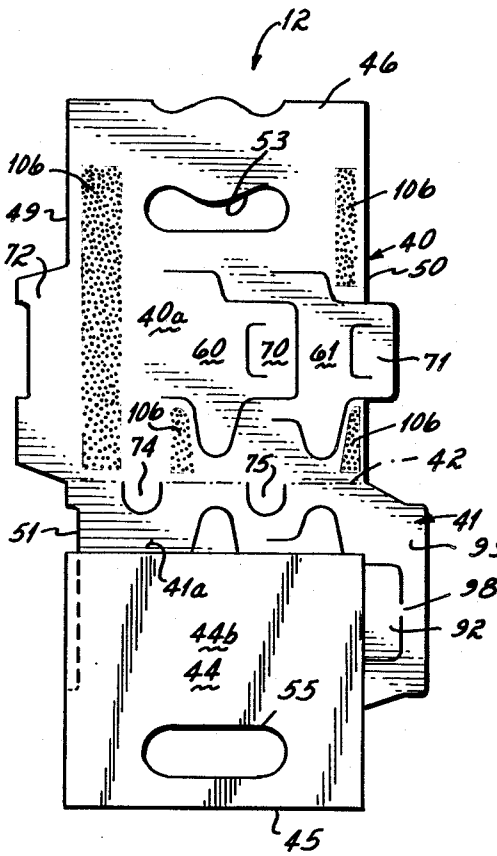
FIG. 3 is a view of the center wall blank similar to FIG. 2 but showing that wall blank in a first assembly step.

In the FIG. 4 attitude, the reverse face **41*b* of the second cell divider panel section 41 is now in view, and the glue flap 46 attached to the first cell divider panel section 40 is folded over onto the reverse face of that second cell divider panel section. With glue having been applied to the top edge of the reverse face 41*b* of the second cell divider panel section 41 as shown by stippled area 107, and after the glue flap 46 is folded and glued thereto, then the first 40 and second 41 cell divider panel sections, and the center reinforcement wall 44, are all retained together in sandwich configuration as shown in FIG. 5. The last pre-assembly steps before gluing the center wall blank 12 to the body blank 11 is illustrated in FIGS. 6 and 7. As shown in FIG. 5, the end wall connector flap 99 attached to the second cell divider panel section 41 (along with glue tab 92 integral therewith) is folded over onto the reverse side 41*b* of that second cell divider panel section 41, and the end wall connector flap 72 attached to the first cell divider panel section 40 is folded under onto the reverse side 40*b* of that first cell divider panel section. With the center wall blank 12 now in the FIG. 6 configuration where it is fully pre-assembled into center wall 43, that center wall is ready to be assembled with the body blank 11**.

Figure 9:
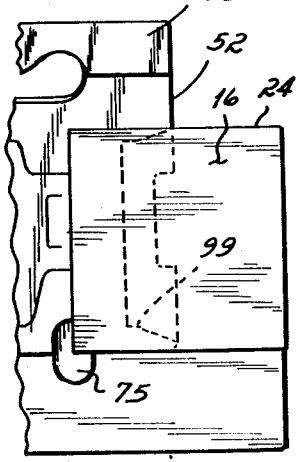
FIG. 9 is a partial view similar to the right side of FIG. 8 showing a second assembly step for the body blank with the pre-assembled center wall blank.
Figure 8:
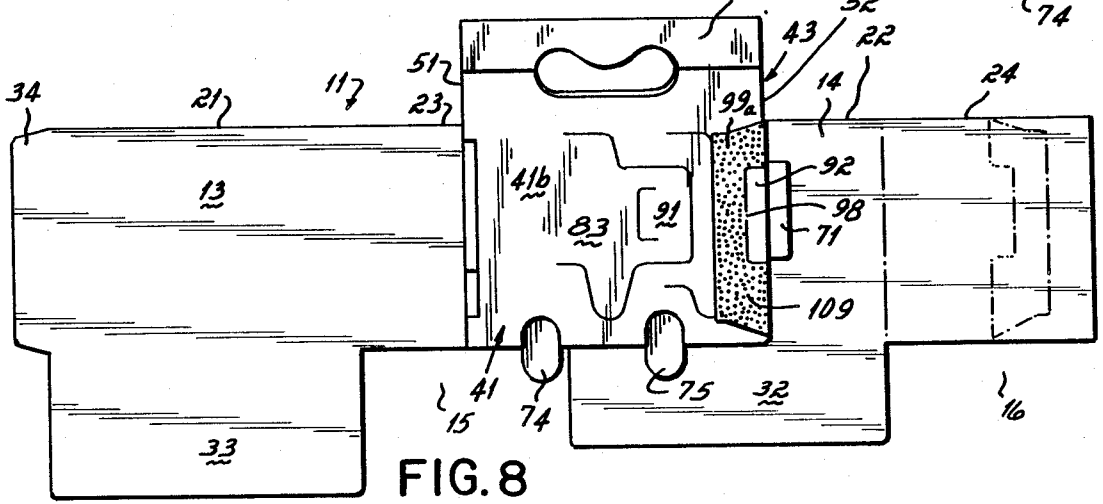
FIG. 8 is a plan view similar to FIG. 7 illustrating the result of the first assembly step of the pre-assembled center wall blank with the body blank.

In assembly of the FIG. 6 center wall 43 with the body blank 11, initially the reverse sides **70*b*, 71*b* of the glue tabs 70, 71 for the cell divider panels 60, 61 cut out of the first cell divider panel section 40 are coated with glue, and the obverse side 72*a* of the end wall connector flap 72 folded under onto the reverse face 40*b* of the first cell divider panel section 40 is likewise coated with glue, as shown by the stippled areas 108 in FIG. 7. The FIG. 7 center wall 43 is then laid down onto the inside face 11*a* of the flat body blank 11 as shown by the phantom line positions in FIG. 7 to establish the assembly step illustrated in FIG. 8. In this attitude, note that the end wall connector flap 72 of the first cell divider panel section 40 is fixed to end wall panel blank 15*b* of end wall 15. Also note that glue tabs 70, 71 of cell divider panels 60, 61 are fixed to side wall 14. Subsequently, and as shown in FIGS. 8 and 9, the obverse face 99*a* of the end wall connector flap 99 of the second cell divider panel section 41, which has been folded over onto the reverse face 41*b* of the second cell divider panel section 41, is coated with glue as shown by stippled area 109, and the end wall 16 of the body blank 11 folded on fold line 19 into the FIG. 9 position. This results in the end wall connector flap 99 of the second cell divider panel section 41 being fixed to end wall panel 16*b* of end wall 16 in the phantom line area shown in FIG. 8. This means that in final assembly of the basket carrier 10 the end wall connector flap 72 fixed to the first cell divider panel section 40 is interconnected with end wall 15 on one side of the center wall 43, and end wall connector flap 99 fixed to the second cell divider panel section 41 is fixed to end wall 16 on the opposite side of the center wall when the carrier is erected as shown in FIG. 1**.

In the next step, compare FIG. 9 with FIG. 10, end wall panel **16*b* of end wall 16 is folded on its fold line 16*c* so that the outside face of end wall panel 16*b* overlies the outside face of end wall panel 16*a* and the glue flap 34 is folded on the side panel 13. Glue tab 92 of cell divider panel 82 is simultaneously folded with end wall panel 16*b* because the breakout point 98 connection is still intact. Subsequently, glue, as shown in the stippled areas 110, is placed on the reverse faces 91*a*, 92*a* of glue tabs 91, 92 on the cell divider panels 83, 84 and on the reverse flap 34*a* of glue flap 34 at the end edge 20 of side wall 13. That side wall 13 is then folded on fold line 17 in the final FIG. 11** configuration.

With the above series of assembly steps, the cell divider panels 60, 61, 83, 84 have now all been interconnected with their respective side walls 13, 14, the center wall 43 has the first 40 and second 41 cell divider panel sections and the center reinforcement panel 44 glued firmly one to the other, and the carrier's body is formed by glue flap 34 fixed to side wall being glued at a seam 35 to inside surface of end wall panel **16*b* at a corner 36 of the carrier. In this final as-glued configuration, the carrier 10 is in the knock-down or shipping attitude. In the flattened or shipping attitude, and as shown in FIG. 11, note particularly that the floor panels 32, 33 are not glued or otherwise connected directly one to the other, and that the floor connector tabs 74, 75 simply extend free down beyond the bottom edge 25–28** of the knock down carrier.

When use of the bottom loading basket carrier 10 is desired, the carrier is first initially erected from the knock-down or shipping attitude illustrated in FIG. 11 into the use attitude shown in FIG. 1. This is achieved simply by exposing the carrier to opposite forces on the flattened carrier's end walls as shown by phantom arrows 111, 112. Upon exposure to these forces 111, 112, the flattened carrier 10 in FIG. 11 partially erects into the FIG. 12 attitude and then fully erects into the FIG. 1 attitude.

In the fully erect FIG. 1 attitude, note that the bottom loading basket carrier's floor panels 32, 33 are open and, in fact, are co-planar with side walls 14, 13. This opened or loading attitude of the basket carrier 10 presents access to each of the individual cells 113 (six being shown in the carrier illustrated) to bottles 114 which have been previously formed into a 3×2 matrix. With six bottles 114 positioned in the 3×2 matrix, the open floor panel basket carrier is simply lowered over that formation in the direction shown by phantom arrow 30 until the carrier's bottom edge 25–28 is co-extensive with that plane (not shown) within which the bottle 114 matrix is supported.

Subsequently, and as shown in FIG. 1A, the carrier's floor panels 32, 33 are closed and glued one to the other, and to the center wall's floor connector tabs 74, 75, to provide an integrated floor support for the carrier. Specifically, the floor panel 32 is first folded on fold line 27 until that floor panel's outer edge **32*x* is co-extensive with the center wall 43. In this intermediate floor closure attitude, both floor connector tabs 74, 75 are folded underneath the floor panel 32, and are glued to that floor panel. Subsequently, the floor panel 33 is folded on fold line 25 until it contacts the undersurface of floor panel 32. The extra width of the floor panel 33 (relative to the width of floor panel 32) functions as a glue flap so that the floor panel 33 can be glued to the underside of the floor panel 32 and to the underside of glue tabs 74, 75. This firmly secures the floor panels 32, 33 together, and also firmly secures the floor connector tabs 74, 75 to both floor panels as well as trapping those tabs between those floor panels. The final basket carrier 10 with bottles 114 therein is shown in FIG. 1A, and presents a basket structure which firmly interconnects the floor 32, 33 not only with side walls 13, 14 along fold lines 25, 27, but also with center wall 43 through floor connector tabs 74, 75. This firm interconnection creates a rigidity to the finalized basket carrier 10 that provides greater support for bottles 114 because the floor is now integral with the side walls 13, 14 and with the center wall 43. Further, since the floor 32, 33 is now integral with the carrier's center wall 43, there is a degree of squareness provided to the carrier's corners which will not be lost due to paperboard memory, i.e., the carrier's corners will be retained in square corner configuration throughout use of the carrier because the carrier no longer can react to a tendency to collapse back toward the flattened shipping attitude illustrated in FIG. 11** during use.

Having described in detail the preferred embodiment of my invention, what I desire to claim and protect by Letters Patent is:

1. A basket carrier comprising a body comprising opposed side walls, opposed end walls and a floor, said body being fabricated from a separate one piece body blank in which said walls' end edges are all parallel one to the other, said body blank thereby incorporating said walls on a longitudinal axis oriented normal to said walls' end edges, each end wall comprising two end wall panels formed integral one with the other, said end wall panels being joined in a fold line parallel to said end wall's end edges, at least one of said end wall panels being foldably connected to an end edge of an adjacent side wall, and a glue flap foldably connected to an end edge of one of a side wall and an end wall, said side and end walls thereby being joined in body configuration at a seam in a corner of said body, said floor comprising a first floor panel foldably connected to one side wall and a second floor panel foldably connected to the other side wall, said first and second floor panels being sized to overlap one another, said first and second floor panels being glued to one another where same overlap, a center wall comprising a cell divider panel section and a handle, said center wall being fabricated from a separate one piece center wall blank having an end wall connector flap at each end edge thereof, said end wall connector flaps being fixed to said end walls to retain said body and center wall in assembly as a basket carrier, and at least one connector tab foldably connected to said center wall, said connector tab being located between the overlap of said first and second floor panels, a first surface of said connector tab being glued to one of said floor panels and a second surface of said connector tab being glued to the other of said floor panels, said center wall thereby being securely glued to said floor which enhances the vertical support for bottles positioned within said cells and also which aids in maintenance of squared corners for said carrier during use.

2. A basket carrier as set forth in claim 1, said carrier comprising at least one cell divider panel connected between said center wall and a side wall on each side of said center wall to provide at least four cells for said carrier, two cell divider panel sections each of which is connected to a cell divider, said cell divider panel sections being foldably joined along one of the top and bottom edges of said center wall, and one of said end wall connector flaps being connected to one of said cell divider panel sections, and the other of said end wall connector flaps being connected to the other of said cell divider panel sections.

3. A basket carrier as set forth in claim 2, said carrier comprising a center reinforcement panel positioned between said two cell divider panel sections, said center reinforcement panel being foldably joined to one of said cell divider panel sections, said center wall blank incorporating said center reinforcement panel and both said cell divider panel sections on a longitudinal axis oriented parallel to the end edges of said cell divider panels.

4. A basket carrier as set forth in claim 3, one of said cell divider panels comprising a glue flap partially formed out of one of said end wall connector flaps, said glue flap being releasably fixed thereto by a breakout point in order to aid in assembly of said carrier.

* * * * *